US007301113B2

(12) United States Patent
Nishimura et al.

(10) Patent No.: US 7,301,113 B2
(45) Date of Patent: Nov. 27, 2007

(54) DIAPHRAGM FOR USE IN SWITCH, METHOD FOR MANUFACTURING THEREOF, MEMBRANE SWITCH, AND INPUT DEVICE

(75) Inventors: Tatsuya Nishimura, Sakura (JP); Toshiaki Kasai, Sakura (JP); Yuuitsu Sakuraba, Sakura (JP); Nobumasa Misaki, Sakura (JP)

(73) Assignee: Fujikura Ltd., Tokyo (JP)

( * ) Notice: Subject to any disclaimer, the term of this patent is extended or adjusted under 35 U.S.C. 154(b) by 0 days.

(21) Appl. No.: 11/267,309

(22) Filed: Nov. 7, 2005

(65) Prior Publication Data

US 2006/0096847 A1 May 11, 2006

(30) Foreign Application Priority Data

Nov. 8, 2004 (JP) ..... 2004-324374
Nov. 30, 2004 (JP) ..... 2004-346886

(51) Int. Cl.
*H01H 5/30* (2006.01)

(52) U.S. Cl. ..... 200/406; 200/516

(58) Field of Classification Search ..... 200/406, 200/83 R, 83 B, 516
See application file for complete search history.

(56) References Cited

U.S. PATENT DOCUMENTS 2,315,758 A * 4/1943 Willits ..... 200/83 B
3,133,170 A * 5/1964 Nanninga ..... 200/406
4,021,630 A 5/1977 Taylor
4,029,916 A * 6/1977 Chu ..... 200/5 A
4,084,071 A * 4/1978 Smith ..... 200/5 S
4,195,210 A * 3/1980 Pounds et al. ..... 200/516
4,254,309 A * 3/1981 Johnson ..... 200/5 A
4,412,113 A * 10/1983 Mitsugi et al. ..... 200/406
4,985,973 A * 1/1991 Yoshimura et al. ..... 29/896.91
5,136,131 A * 8/1992 Komaki ..... 200/516
5,193,669 A * 3/1993 Demeo et al. ..... 200/512
5,294,762 A 3/1994 Kaizu et al.
5,399,823 A * 3/1995 McCusker ..... 200/521
5,451,285 A * 9/1995 Santo et al. ..... 200/516
5,898,147 A * 4/1999 Domzalski et al. ..... 200/1 B
5,909,804 A 6/1999 Kuratani
5,924,555 A * 7/1999 Sadamori et al. ..... 200/512
6,133,536 A 10/2000 Hunag et al.
6,303,888 B1 10/2001 Okamoto et al.
6,392,177 B1 5/2002 Zhang et al.
6,498,312 B1 * 12/2002 Villain ..... 200/510
6,502,668 B1 1/2003 Chida et al.
6,563,068 B2 * 5/2003 Yamagata et al. ..... 200/406
6,593,537 B2 7/2003 Teruyama et al.
6,683,265 B2 * 1/2004 Masuda ..... 200/406
6,700,508 B1 3/2004 Nomura et al.
6,747,218 B2 * 6/2004 Huseman et al. ..... 200/1 B
6,815,628 B2 11/2004 Okita et al.
2004/0129547 A1 7/2004 Tomitsuka et al.

FOREIGN PATENT DOCUMENTS

JP 2004-031154 A 1/2004

* cited by examiner

*Primary Examiner*—Michael A Friedhofer
(74) *Attorney, Agent, or Firm*—Sughrue Mion, PLLC

(57) ABSTRACT

A dome-shaped diaphragm includes a convex portion; a base portion provided on an outer periphery of the convex portion; and a pressing force reducing portion provided in at least one of the convex portion and the base portion. Examples of the pressing force reducing portion may be a hole portion, a reduced thickness portion or any other feature that reduces the pressing force.

38 Claims, 13 Drawing Sheets

DIAPHRAGM FOR USE IN SWITCH, METHOD FOR MANUFACTURING THEREOF, MEMBRANE SWITCH, AND INPUT DEVICE

CROSS-REFERENCE TO RELATED APPLICATIONS

This application is based upon and claims the benefit of priority from Japanese Patent Application No. 2004-324374, filed Nov. 8, 2004, and Japanese Patent Application No. 2004-346886, filed Nov. 30, 2004, the contents of which are incorporated herein in their entirety by reference.

BACKGROUND OF THE INVENTION

1. Field of the Invention

The invention relates to a diaphragm for use in a switch employing a dome-shaped switch for various electronic apparatuses, and a method for manufacturing the same. In addition, the invention relates to a membrane switch and an input device employing the above diaphragm for use in a switch.

2. Description of the Related Art

Dome-shaped switches are used in various electronic apparatuses. Such switches include, as shown in FIG. 1A, a contact member (hereinafter, referred to as "diaphragm") 103 made of a conductive material and which is disposed on a wiring board 100 having a C-shaped first electrode 101 and a second electrode 102 located at the center portion of the first electrode 101 and spaced apart therefrom. Via the diaphragm 103, an electric contact is established between the first electrode 101 and the second electrode 102, which are insulated from each other, which turns the switch on. A part of a lead portion extending from the second electrode 102 is covered with an insulating sheet 104 so that the lead portion is insulated from the diaphragm 103.

As shown in FIG. 1B, the diaphragm 103 is disposed above the wiring board 100 so that the periphery of the diaphragm 103 comes in contact with the C-shaped first electrode 101.

As shown in FIG. 1C, when the center portion of the diaphragm 103 in which the periphery thereof comes in contact with the first electrode 101 is depressed, the center portion of the diaphragm 103 comes in contact with the second electrode 102. As a result, an electric contact is established between the first electrode 101 and the second electrode 102 via the diaphragm 103, which turns the switch on.

In the related art technique, a round dome-shaped diaphragm for use in a switch (switch diaphragm), such as the one shown in FIGS. 2A and 2B, is used, and a switch is constructed so that the electric connection between the first and the second electrodes 101 and 102 is controlled via the diaphragm 103.

The round dome-shaped switch diaphragm 103 includes a convex curved portion and a base portion provided therearound (see FIG. 2A). When the center portion of the switch diaphragm 103 is depressed, a portion extending between the convex curved portion and the base portion is deformed (see FIG. 2B). As a result, the center portion of the diaphragm 103, the periphery (base portion) of which comes in contact with the first electrode, comes in contact with the second electrode 102 (see, for example, Japanese Patent Application, First Publication No. 2004-31154).

Furthermore, recently, the reduction in the sizes of electronic apparatuses has resulted in a reduction in the sizes of various switches. Consequently, a reduction in the diameter of round dome-shaped diaphragms used in dome-shaped switches is desired. However, a small-diameter diaphragm has a short operating stroke, which does not provide a satisfactory "click feeling" to users. To address this issue, a new approach has been proposed in which a round dome-shaped diaphragm having a larger curvature is used to extend the operating stroke, for example. However, a larger load is required to click a round dome-shaped diaphragm having a large curvature, which may impair the "click feeling."

SUMMARY OF THE INVENTION

The invention was conceived in light of the above-described circumstances, and a first aspect of the invention is directed to a dome-shaped diaphragm, including a convex portion; a base portion provided on an outer periphery of the convex portion; and a hole provided in at least one of the convex portion and the base portion. With the switch diaphragm according to the first aspect of the invention, the load required for making a click can be reduced by reducing the area of a deformed portion upon a click by providing the hole in the convex portion, or in the base portion, or in both the convex and the base portions of the dome-shaped diaphragm. Thus, a satisfactory "click feeling" can be obtained even with a diaphragm having a reduced size or having an extended operating stroke.

Furthermore, a second aspect of the invention is directed to a dome-shaped diaphragm, including: a convex portion; a base portion provided on an outer periphery of the convex portion; and a reduced thickness portion provided in at least one of the convex portion and the base portion. With the switch diaphragm according to the second aspect of the invention, the load required for making a click is reduced by providing a reduced thickness portion in the dome-shaped diaphragm having the convex portion and the base portion, in the convex portion, or in the base portion, or in both the convex and the base portions. Thus, a satisfactory "click feeling" can be obtained even with a diaphragm having a reduced size or having an extended operating stroke.

Furthermore, the reduced thickness portion formed in the convex portion, or in the base portion, or in both the convex and the base portions of the round dome-shaped diaphragm reduces the thickness of the deformed portion. Thus, the load required for making a click can be reduced, and a satisfactory "click feeling" can be obtained.

Furthermore, a third aspect of the invention is directed to a dome-shaped diaphragm, including: a convex portion; a base portion provided on an outer periphery of the convex portion; and a plurality of leg portions provided on an outer periphery of the base portion; and a hole provided in at least one of the convex portion, the base portion, and the leg portions. With the switch diaphragm according to the third aspect of the invention, the operating stroke of the switch diaphragm is extended by providing the leg portion on the outer periphery of the dome-shaped diaphragm main body having the convex portion and the base portion. In addition, the load required for making a click is reduced by providing a hole formed in at least one of the convex portion, the base portion, and the leg portion.

Furthermore, a fourth aspect of the invention is directed to a dome-shaped diaphragm, including: a convex portion; a base portion provided on an outer periphery of the convex portion; and a plurality of leg portions provided on an outer periphery of the base portion; and a reduced thickness portion provided in at least one of the convex portion, the base portion, and the leg portions. With the switch diaphragm in which the operating stroke is extended by the formation of the leg portion, the load required for making a click is reduced by providing the reduced thickness portion in at least one of the convex portion, the base portion, and the leg portion.

In the switch diaphragm according to the invention, the operating stroke of a switch diaphragm (small-sized diaphragm) having a smaller diaphragm main body can be extended by forming a leg portion on the outer periphery of the dome-shaped diaphragm main body. In addition, the load required for making a click is reduced by reducing the area of a deformed portion upon a click by providing a hole in at least one of the convex portion, the base portion, and the leg portion.

In the switch diaphragm in which the operating stroke is extended by the formation of the leg portion, the load required for making a click is reduced by reducing the thickness of the deformed portion by providing the reduced thickness portion in at least one of the convex portion, the base portion, and the leg portion. Thus, by using a switch diaphragm having an extended operating stroke and requiring a reduced load for making a click, a satisfactory "click feeling" can be obtained with a dome-shaped switch using a small-sized diaphragm.

A fifth aspect of the invention is directed to a dome-shaped diaphragm, including a convex portion; a base portion provided on an outer periphery of the convex portion; and a pressing force reducing portion provided in at least one of the convex portion and the base portion. With the switch diaphragm according to the fifth aspect of the invention, the load required for making a click can be reduced by reducing the area of a deformed portion upon a click by providing the pressing force reducing portion in the convex portion, or in the base portion, or in both the convex and the base portions of the dome-shaped diaphragm. Thus, a satisfactory "click feeling" can be obtained even with a diaphragm having a reduced size or having an extended operating stroke.

A fifth aspect of the invention is directed to a membrane switch in which the above-described diaphragm is used. With the membrane switch according to the fifth aspect of the invention, the load required for making a click can be reduced and a satisfactory "click feeling" can be provided.

A sixth aspect of the invention is directed to an input device in which the above-described diaphragm is used. With the membrane switch according to the sixth aspect of the invention, the load required for making a click can be reduced and a satisfactory "click feeling" can be provided.

A seventh aspect of the invention is directed to a method for manufacturing a diaphragm, including: providing a sheet material; and forming a convex portion in the sheet material. Further, a pressing force reducing portion, hole portion, or reduced thickness portion may also be formed.

BRIEF DESCRIPTION OF THE DRAWINGS

The above and other objects, features and advantages of the invention will become more apparent by describing in detail exemplary embodiments thereof with reference to the attached drawings in which.

DETAILED DESCRIPTION OF THE INVENTION

Figure 1A:
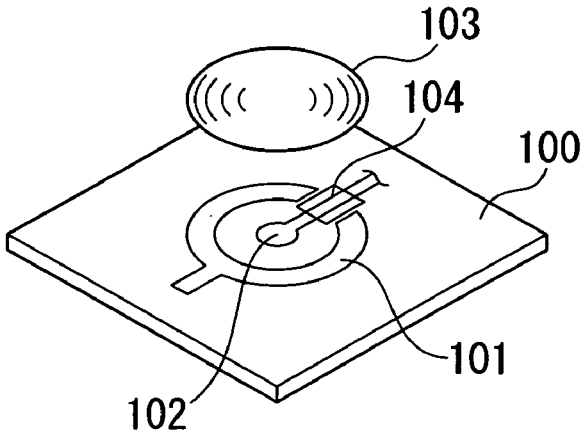
FIG. 1A is a perspective view illustrating a related art dome-shaped switch.

Exemplary embodiments of the invention will now be described below by reference to the attached FIGS. The described exemplary embodiments are intended to assist the understanding of the invention, and are not intended to limit the scope of the invention in any way.

A diaphragm 210 for use in a switch (switch diaphragm 210) according to exemplary embodiments of the invention will be described with reference to FIG. 3A to FIG. 6. It should be noted that, in the figures, some reference numerals have letters appended thereafter. When such reference numerals are referred to by the numbers only, the elements referred to by the reference numerals are generally referenced.

Figure 3A:
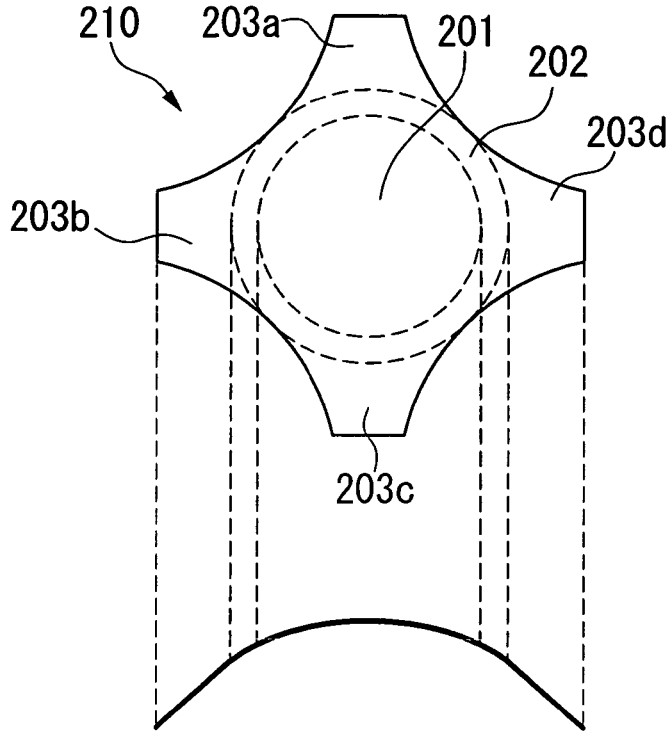
FIGS. 3A and 3B are views illustrating switch diaphragms according to a first exemplary embodiment of the invention.
Figure 3B:
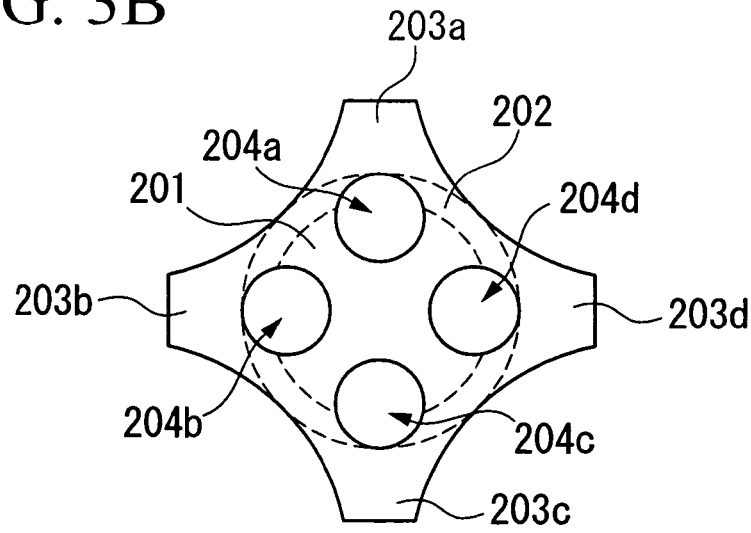

FIGS. 3A and 3B are views illustrating switch diaphragms according to a first exemplary embodiment of the invention.

The switch diaphragm 210 of the first embodiment includes a round dome-shaped diaphragm main body having a convex curved portion 201 and a base portion 202, and leg portions 203 (203*a*-203*d*) that are formed steeper than the base portion 202 provided around the outer periphery of the diaphragm main body. The diaphragm main body and the leg portions 203 are formed in one piece in order to extend an operating stroke of the switch diaphragm. Furthermore, at least one hole 204 (204*a*-204*d*) is formed in the diaphragm 210 in order to reduce the load required for making a click. That is, the leg portions 203 are supporting members for the diaphragm that are provided around the outer periphery of the dome-shaped diaphragm main body in order to extend the operating stroke, and are formed as protrusions extending from portions of the outer periphery of the base portion 202. The switch diaphragm 210 having the leg portions 203 is placed on a wiring board with the leg portions 203 coming in contact with a first electrode formed on the wiring board.

At least two leg portions 203 may be provided around the outer periphery of the diaphragm main body, and the leg portions may be formed such that they are arranged at regular intervals around the outer periphery of the diaphragm main body. Furthermore, a plurality of the holes 204 may be provided in the switch diaphragm 210, and the holes 204 may be arranged at regular intervals around the circumference. Furthermore, the holes 204 may be provided at the positions corresponding to the positions of the leg portions 203.

As shown in FIG. 3A, four leg portions 203*a*-203*d* are formed around the outer periphery of the diaphragm main body in one piece at regular intervals (at an interval of 90°) in this embodiment.

Additionally, as shown in FIG. 3B, the circular holes 204*a*-204*d* are formed extending over the convex curved portion 201 and the base portion 202 so that they are arranged at regular intervals around the circumference. It should be noted that the four holes 204*a*-204*d* are formed at the positions corresponding to the positions of the leg portions 203*a*-203*d* in the switch diaphragm 210 according to this embodiment.

When the center portion of the switch diaphragm 210 in which the leg portions 203 thereof come in contact with a first electrode (not shown) formed on a wiring board is depressed, the portion of the switch diaphragm 210 extending over the convex curved portion 201, the base portion 202, and the leg portions 203 is deformed. As a result, the center portion comes in contact with a second electrode (not shown) formed on the wiring board.

In this case, the switch diaphragm 210 according to the invention reduces the load required for making a click by reducing the area of the deformed portion.

The material of the switch diaphragm 210 may include, for example, a conductive material, such as stainless steel or a copper alloy. SUS301 may be used since spring properties and resistance to fatigue are required.

The thickness of the switch diaphragm 210 may be, for example, between 40 μm and 100 μm. The diameter of the switch diaphragm 210 may be, for example, between 6 mm and 20 mm.

Although the holes 204*a*-204*d* illustrated have circular shapes in FIGS. 3A and 3B, the shapes of the holes 204*a*-204*d* are not limited to a circular shape and may be an elliptical shape. Furthermore, the number of holes is not limited to four. A plurality of holes 204 may be arranged at regular angular intervals with respect to the center of the switch diaphragm 210.

Figure 1B:
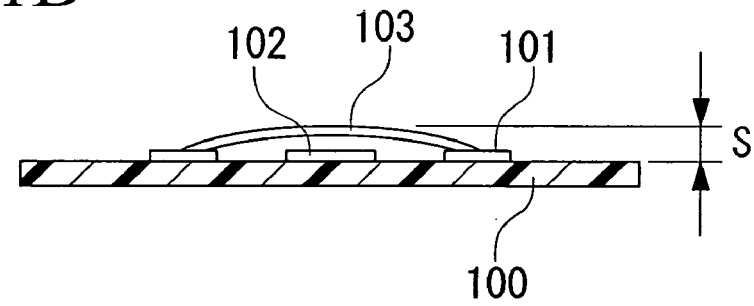
FIG. 1B is a cross-sectional view of the related art dome-shaped switch.
Figure 1C:
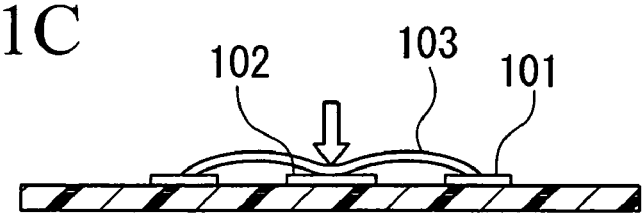
FIG. 1C is a cross-sectional view of the related art dome-shaped switch when it is depressed.
Figure 2A:
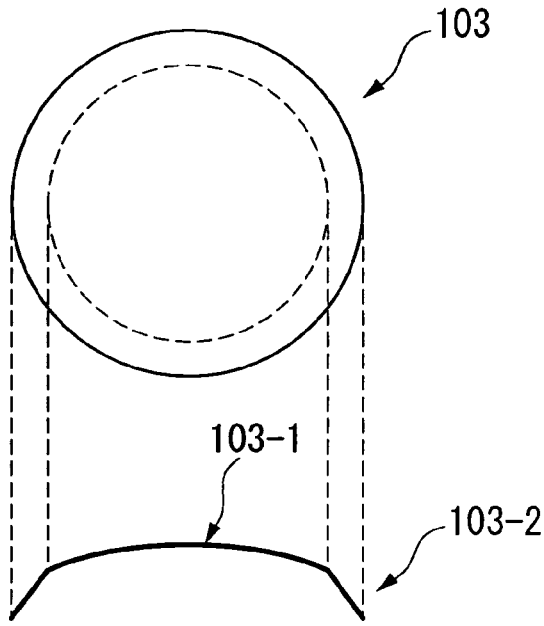
FIGS. 2A and 2B are views illustrating related art diaphragms for use in a switch.
Figure 2B:
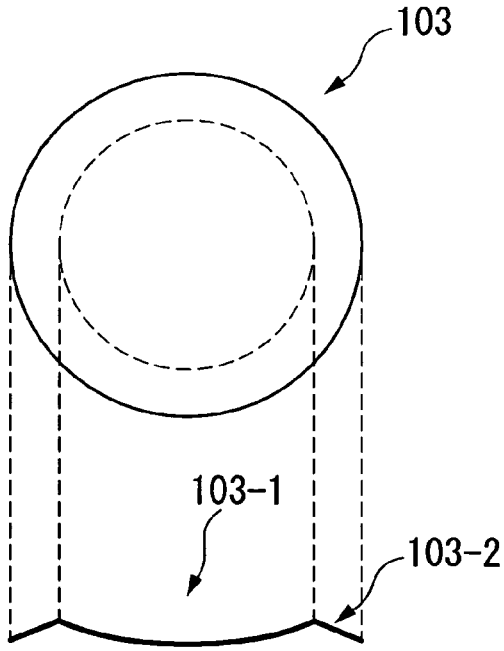

The loads required to click two types of switch diaphragm in which the leg portions were provided around the outer periphery of the diaphragm main body in order to extend the operating stroke were measured: one was the switch diaphragm 210 (see FIG. 3B) provided with the holes 204*a*-204*d* in both the convex curved portion 201 and the base portion 202; and another was a switch diaphragm without holes (see FIG. 1). The results are shown in the graph in FIG. 4.

Figure 4:
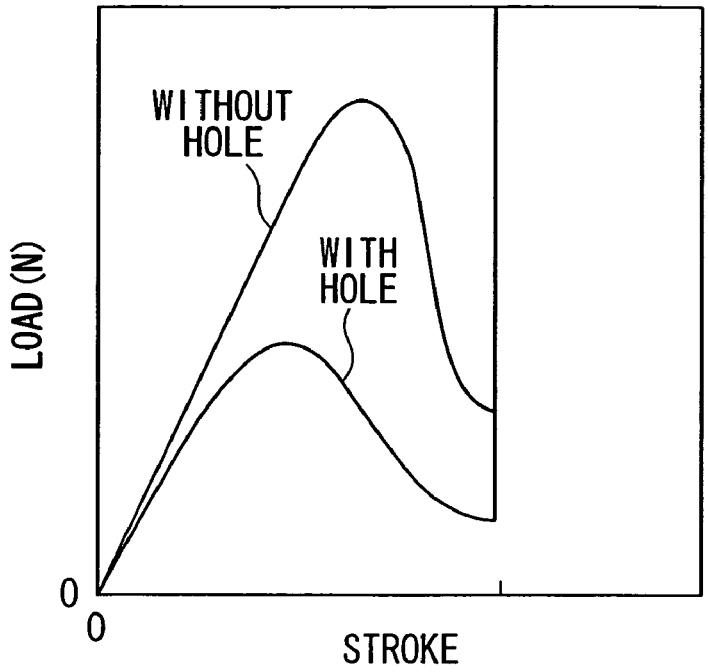
FIG. 4 is a graph showing a load applied to the switch diaphragms shown in FIGS. 3A and 3B when they are clicked.

FIG. 4 indicates that provision of the holes formed extending over the convex curved portion 201 and the base portion 202 in the switch diaphragm 210 in order to extend the operating stroke significantly reduced the load required for making a click.

Next, switch diaphragms according to second and third embodiments of the invention will be described with reference to FIG. 5 and FIG. 6.

Figure 5:
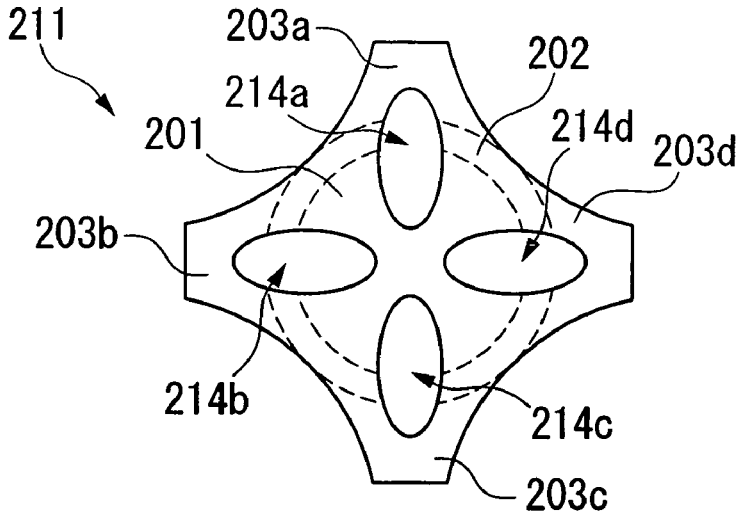
FIG. 5 is a plan view illustrating a switch diaphragm according to a second exemplary embodiment of the invention.

FIG. 5 is a plan view illustrating a switch diaphragm 211 according to the second exemplary embodiment.

As in the first embodiment shown in FIG. 5, the switch diaphragm 211 of the second embodiment includes four leg portions 203*a*-203*d* provided around the outer periphery of a diaphragm main body, which are formed in one piece in order to extend an operating stroke of the switch diaphragm 211. Furthermore, holes 214*a*-214*d* are formed extending over the convex curved portion 201 and the base portion 202 at the positions corresponding to the positions of the leg portions 203*a*-203*d* in order to reduce the load required for making a click.

In this embodiment, the holes 214*a*-214*d* are elliptical and formed extending over the convex curved portion 201, the base portion 202, and the leg portions 203.

The four holes 204*a*-204*d* are provided extending over the convex curved portion 201 and the base portion 202 in the first embodiment shown in FIGS. 3A and 3B, and the four holes 214*a*-214*d* are provided extending over the convex curved portion 201, base portion 202, and the leg portions 203 in the second embodiment. However, holes formed extending over the base portion 202 and the leg portions 203 may be provided; alternatively, holes formed extending over the convex curved portion 201, or the base portion 202, or the leg portions 203 may be provided.

It should be noted that the holes formed extending over the convex curved portion 201 and the base portion 202 may be holes formed in the boundary between the convex curved portion 201 and the base portion 202, and holes formed extending over the base portion 202 and the leg portions 203 may be holes formed in the boundary between the base portion 202 and the leg portions 203.

Figure 6:
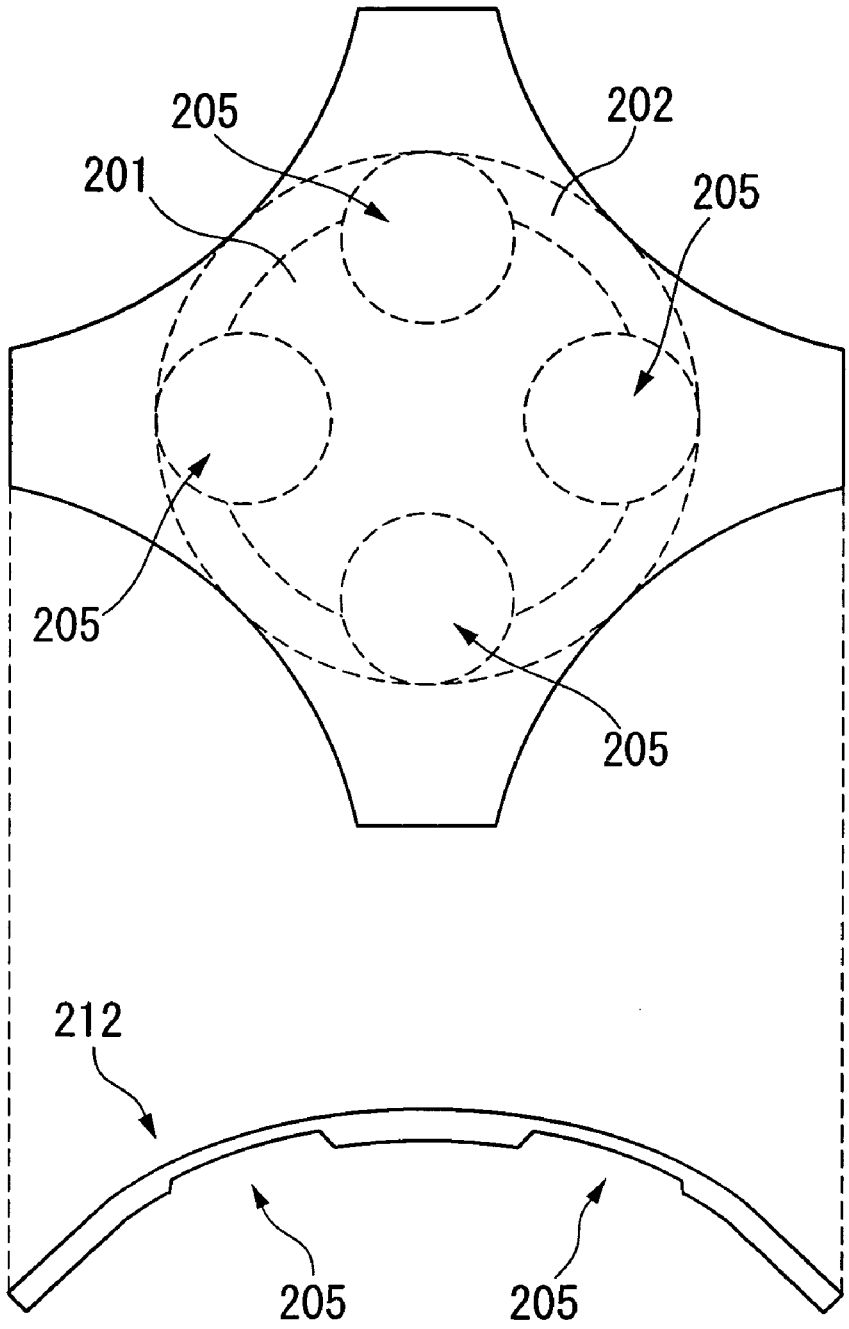
FIG. 6 is a view illustrating a switch diaphragm according to a third exemplary embodiment of the invention.

FIG. 6 is a plan view illustrating a switch diaphragm 212 according to the third exemplary embodiment.

As in the first and the second embodiments, the switch diaphragm 212 of the third embodiment includes four leg portions 203 that are formed steeper than the base portion 202 provided around the outer periphery of a diaphragm main body, and is formed in one piece in order to extend an operating stroke of the switch diaphragm. However, in order to reduce the load required for making a click, reduced thickness portions 205 having a reduced thickness are provided, rather than forming the holes 204 extending from the convex curved portion 201 to the base portion 202.

Similar to the holes formed in switch diaphragms of the first and second exemplary embodiments, a plurality of reduced thickness portions 205 may be provided arranged at regular intervals around the circumference, and the reduced thickness portions 205 may be provided at the positions corresponding to the positions of the leg portions 203 in this embodiment. Furthermore, the reduced thickness portions 205 may be provided in the entire boundary between the convex curved portion 201 and the base portion 202.

The reduced thickness portions 205 are provided extending over the convex curved portion 201 and the base portion 202 in the third embodiment. However, it should be noted that reduced thickness portions 205 extending over the base portion 202 and the leg portions 203 may be provided; the reduced thickness portions 205 may be provided extending over the convex curved portion 201, the base portion 202, and the leg portions 203; or reduced thickness portions 205 extending over the convex curved portion 201, or the base portion 202, or the leg portions 203 may be provided.

It should be noted that reduced thickness portions 205 formed extending over the convex curved portion 201 and the base portion 202 may be reduced thickness portions 205 formed in the boundary between the convex curved portion 201 and the base portion 202, and reduced thickness portions 205 extending the base portion 202 and the leg portions 203 may be reduced thickness portions formed in the boundary between the base portion 202 and the leg portions 203.

Although the reduced thickness portions 205 illustrated have circular shapes in FIG. 5, the shapes of the reduced thickness portions 205 are not limited to a circular shape and may be an elliptical shape. Furthermore, the number of reduced thickness portions is not limited to four.

Figure 7:
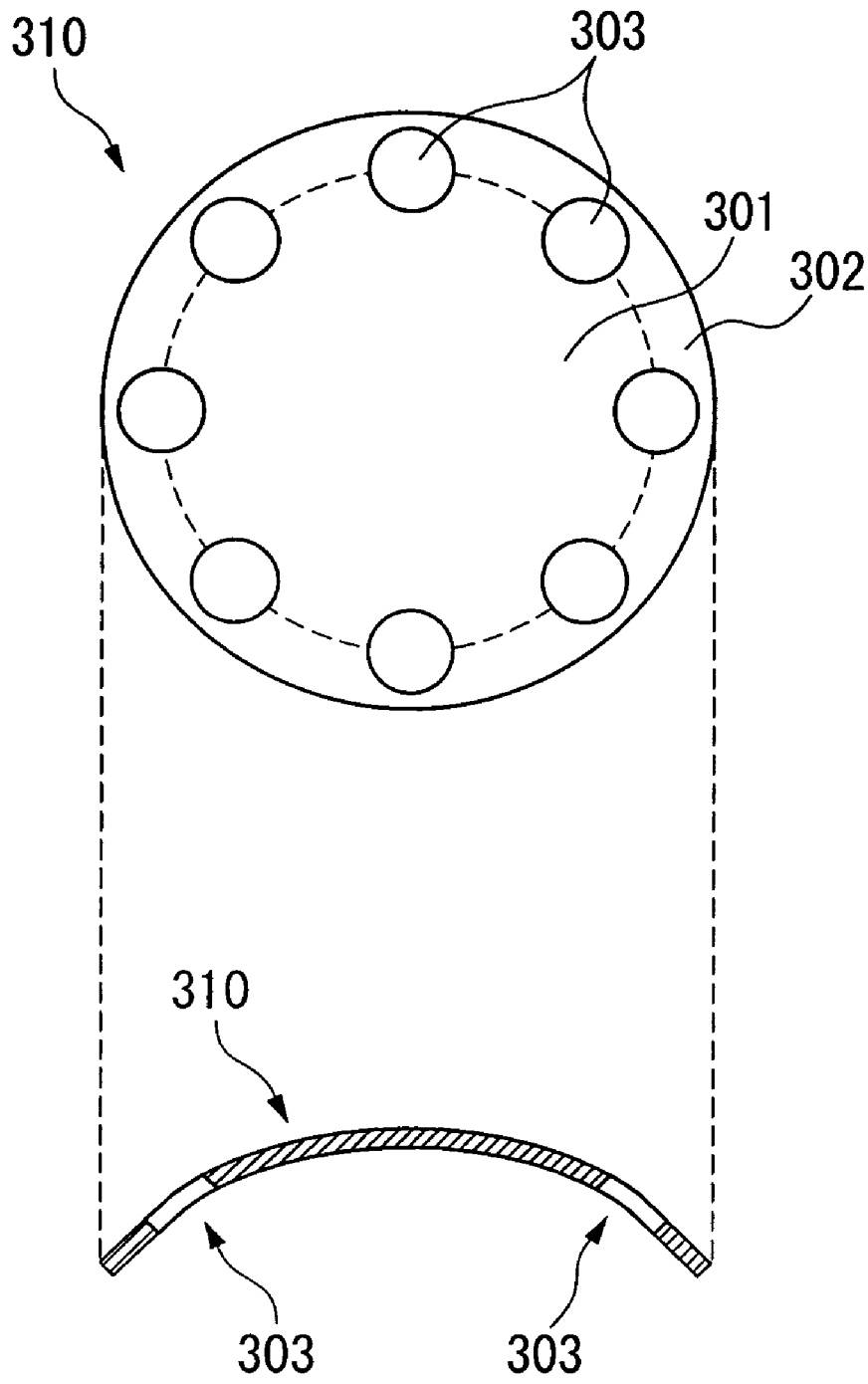
FIG. 7 is a view illustrating a switch diaphragm according to a fourth exemplary embodiment of the invention.

FIG. 7 is a view illustrating a switch diaphragm according to a fourth exemplary embodiment of the invention.

The diaphragm of the fourth embodiment is a round dome-shaped switch diaphragm 310 including a convex curved portion 301 and a base portion 302.

It should be noted that the round dome-shaped switch diaphragm 310 shown in FIG. 7 is placed above a wiring board so that the periphery thereof (the base portion 301) comes in contact with a C-shaped first electrode. The base portion 301 deforms the round dome-shaped switch diaphragm 310 that comes in contact with the first electrode, thereby making the center of the switch diaphragm 310 come in contact with the second electrode. As a result, an electrical contact is defined between the first electrode and second electrode via a diaphragm that is made of a conductive material, for example, SUS steel or a copper alloy.

According to this embodiment, in order to reduce the load required for making a click of the switch, at least one hole 303 is provided in the convex curved portion 301, or in the base portion 302, or in both the convex curved portion and the base portion of the round dome-shaped switch diaphragm 310 in a switch employing this round dome-shaped switch diaphragm 310.

It should be noted that a plurality of holes 303 may be formed in the diaphragm, and the holes 303 may be arranged at regular angular intervals with respect to the center of the round dome-shaped switch diaphragm 310.

In the embodiment shown in FIG. 7, eight circular holes 303 are provided extending over the convex curved portion 301 and the base portion 302, and the holes 303 are arranged at regular angular intervals with respect to the center of the switch diaphragm 310. It should be noted that the shapes of the holes 303 are not limited to a circular shape and the holes 303 may have an elliptical shape or any other shape although eight circular holes 303 are shown in FIG. 7. Furthermore, the number of holes is not limited to eight.

When the center portion of the round dome-shaped switch diaphragm 310 in which the base portion 302 of the switch diaphragm 310 comes in contact with a C-shaped first electrode formed on a wiring board, is depressed, a portion extending between the convex curved portion 301 and the base portion 302 of the switch diaphragm 310 is deformed. As a result, the center portion of the switch diaphragm 310 comes in contact with the second electrode, and an electric contact is established between the first electrode and the second electrode via the switch diaphragm 310.

In the switch diaphragm 310 shown in FIG. 7, the provision of the eight holes 303 reduces the area of the deformed portion of the switch diaphragm 310, thereby reducing the load required for making a click.

The material of the round dome-shaped switch diaphragm 310 may include, for example, a conductive material, such as stainless steel or a copper alloy. SUS301 may be used since spring properties and resistance to fatigue are required.

The thickness of the round dome-shaped switch diaphragm 310 may be, for example, between 40 μm and 100 μm. The diameter of the round dome-shaped switch diaphragm 310 may be, for example, between 6 mm and 20 mm.

The loads required to click two types of round dome-shaped switch diaphragm were measured: one was the round dome-shaped switch diaphragm 310 (see FIG. 7) provided with the holes 303 extending over the convex curved portion 301 and the base portion 302; and another was a switch diaphragm without holes (see FIG. 1). The results are shown in the graph in FIG. 8.

Figure 8:
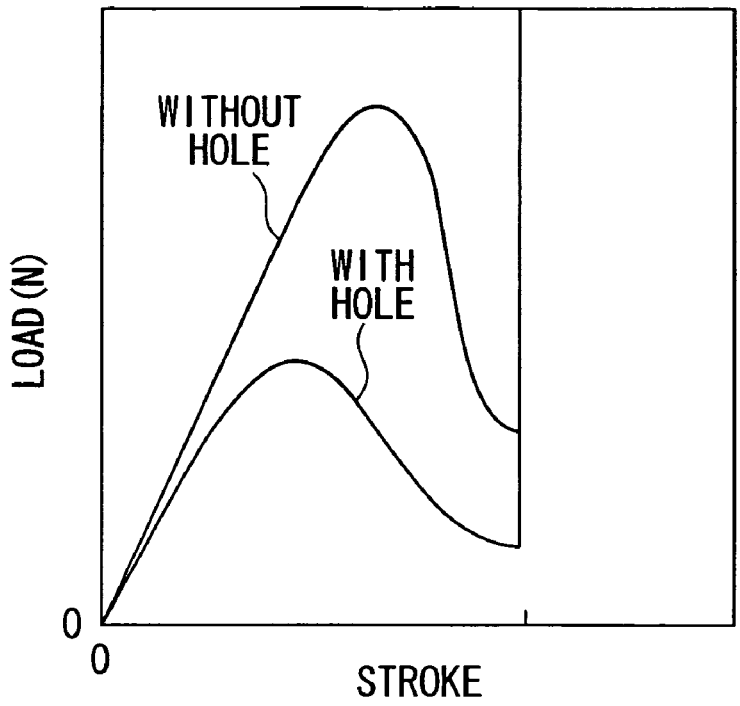
FIG. 8 is a graph showing a load applied to the switch diaphragm shown in FIG. 7 when it is clicked.

FIG. 8 indicates that provision of the holes 303 formed extending over the convex curved portion 301 and the base portion 302 to the switch diaphragm 310 significantly reduced the load required for making a click.

It should be noted that the load required for making a click is reduced in a diaphragm having holes 303 provided in the convex curved portion 301 and a diaphragm having holes 303 provided in the base portion 302 compared to the diaphragm without holes, as shown in the graph of FIG. 8.

Next, switch diaphragms according to other exemplary embodiments of the invention will be described with reference to FIG. 9A to FIG. 11.

Figure 9A:
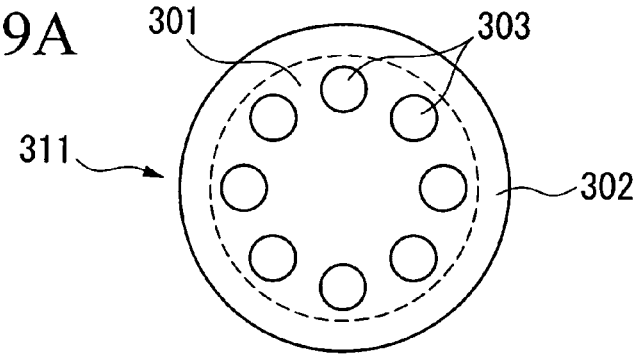
FIG. 9A is a plan view illustrating a switch diaphragm according to a fifth exemplary embodiment of the invention.
Figure 9B:
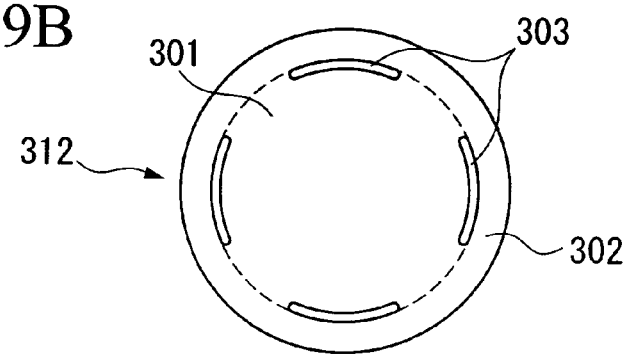
FIG. 9B is a plan view illustrating a switch diaphragm according to a sixth exemplary embodiment of the invention.

FIGS. 9A and 9B are plan views illustrating switch diaphragms 311 and 312 according to fifth and sixth exemplary embodiments.

In the switch diaphragms 311 and 312 according to the fifth and sixth embodiments, a plurality of holes 303 are provided in a round dome-shaped switch diaphragm 310 in order to reduce the load required for making a click, as in the switch diaphragm shown in FIG. 7.

In the fifth embodiment shown in FIG. 9A, eight circular holes 303 are formed in the convex curved portion 301 of the round dome-shaped switch diaphragm 310.

In the sixth embodiment shown in FIG. 9B, four holes 303 having elongated elliptical shapes are formed along the boundary between the convex curved portion 301 and the base portion 302 of the round dome-shaped switch diaphragm 310.

The shape of the holes 303 formed in the switch diaphragm 310 is not limited to circular or elliptical shapes, and holes with any shape may be provided.

Furthermore, the holes 303 may be arranged in any positions provided that the position is outside the center of the switch diaphragm 310, and the holes may be arranged in the convex curved portion 301, as in the fifth embodiment (see FIG. 9A). It should be noted that holes 303 formed extending over the convex curved portion 301 and the base portion 302 may be holes formed in the boundary between the convex curved portion 301 and the base portion 302 (see FIG. 9B).

When a plurality of holes 303 is formed in the switch diaphragm 310, the holes 303 may be arranged at regular angular intervals with respect to the center of the switch diaphragm 310 (see FIGS. 9A and 9B).

Figure 10A:
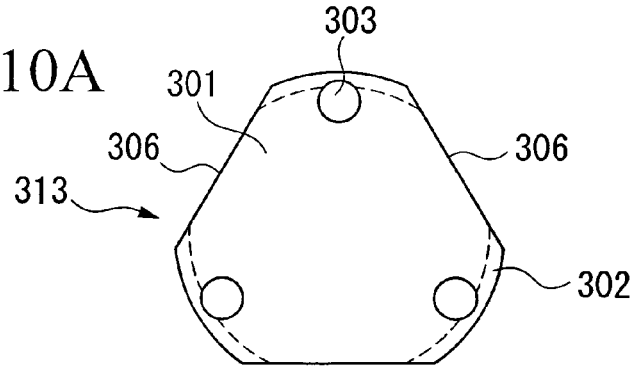
FIG. 10A is a plan view illustrating a switch diaphragm according to a seventh exemplary embodiment of the invention.
Figure 10B:
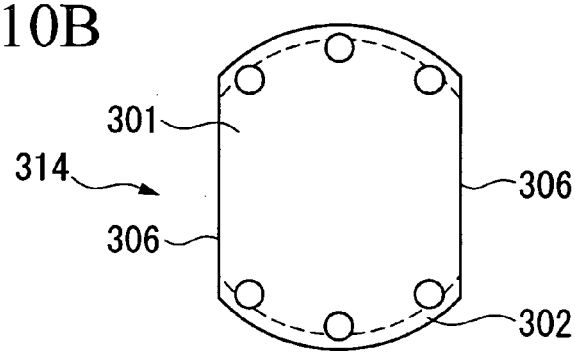
FIG. 10B is a plan view illustrating a switch diaphragm according to an eighth exemplary embodiment of the invention.

FIG. 10A and 10B are plan views illustrating switch diaphragms 313 and 314 according to seventh and eighth exemplary embodiments.

In the switch diaphragms 313 and 314 according to the seventh and eighth embodiments, a plurality of holes 303 are provided in a round dome-shaped switch diaphragm 310 having cut-outs formed around the outer periphery thereof in order to reduce the load required for making a click, as in the switch diaphragms shown in FIG. 7 and FIGS. 9A and 9B.

In the seventh embodiment shown in FIG. 10A, a plurality of holes 303 are provided in a round dome-shaped switch diaphragm 310 having three cut-outs formed around the outer periphery thereof in order to reduce the load required for making a click In the eighth embodiment shown in FIG. 10B, a plurality of holes 303 are provided in a round dome-shaped switch diaphragm 310 having two cut-outs formed around the outer periphery thereof in order to reduce the load required for making a click.

In the embodiments in which cut-outs are provided around the outer periphery portion of the round dome-shaped switch diaphragm 310, the holes 303 for reducing the load required for making a click may be provided in the switch diaphragms 313 and 314 at the positions in which no cut-out is formed, as shown in FIGS. 10A and 10B.

Figure 11:
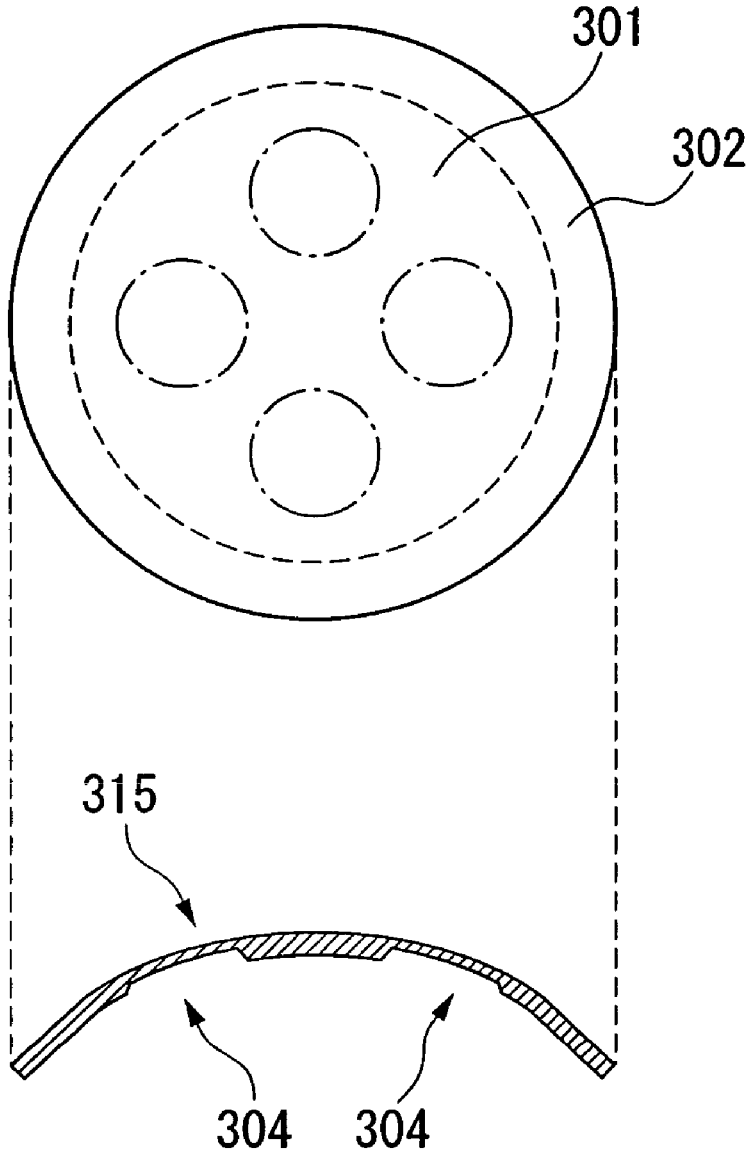
FIG. 11 is a view illustrating a switch diaphragm according to a ninth exemplary embodiment of the invention.

FIG. 11 is a plan view illustrating a switch diaphragm 315 according to a ninth exemplary embodiment. In the switch diaphragm 315 according to this embodiment, at least one reduced thickness portion 304 is provided in the convex curved portion 301, or the base portion 302, or the region extending over the convex curved portion 301 and the base portion 302 of the round dome-shaped switch diaphragm 310 in order to reduce the load required for making a click. That is, at least one reduced thickness portion 304 is formed in which the thickness of the switch diaphragm 315 is reduced in this embodiment, instead of forming holes 303 in the round dome-shaped switch diaphragm 310. The load required for making a click is reduced in a switch diaphragm 315 having at least one reduced thickness portion 304 compared to the switch diaphragm without holes or a thickness portion, as in the switch diaphragm without holes shown in the graph of FIG. 8.

In the embodiment in which the reduced thickness portion 304 is provided in the round dome-shaped switch diaphragm 315, a plurality of reduced thickness portions 304 may be provided in the convex curved portion 301, or in the base portion 302, or in the convex curved portion 301 and the base portion 302, and that the reduced thickness portions 304 be arranged at regular angular intervals with respect to the center of the diaphragm, as in the cases of the holes 303 formed in the switch diaphragm according to the fourth or eighth embodiment. It should be noted that the reduced thickness portion(s) 304 formed extending over the convex curved portion 301 and the base portion 304 may be reduced thickness portion(s) 304 formed in the boundary between the convex curved portion 301 and the base portion 302.

Furthermore, an annular reduced thickness portion may be provided in the switch diaphragm 315 outside the center of the switch diaphragm 315, in addition to the reduced thickness portion(s) 304. For example, a reduced thickness portion 304 may be formed along the boundary between the convex curved portion 301 and the base portion 302.

In addition, a reduced thickness portion(s) 304 may be provided in a round dome-shaped diaphragm having cut-outs formed around the outer periphery thereof, such as the switch diaphragm shown in FIGS. 10A and 10B.

In the switch diaphragm in FIG. 11, four reduced thickness portions 304 are formed in the convex curved portion 301 of the round dome-shaped switch diaphragm 315. It should be noted that the reduced thickness portions 304 are arranged at a regular interval of 90° with respect to the center of the switch diaphragm 315 in this embodiment.

Although the reduced thickness portions 304 illustrated have circular shapes in FIG. 11, the shapes of the reduced thickness portions 304 are not limited to a circular shape and may be an elliptical shape. Furthermore, the number of reduced thickness portions is not limited to four.

Next, an exemplary method for manufacturing a switch diaphragm will be described.

Figure 12:
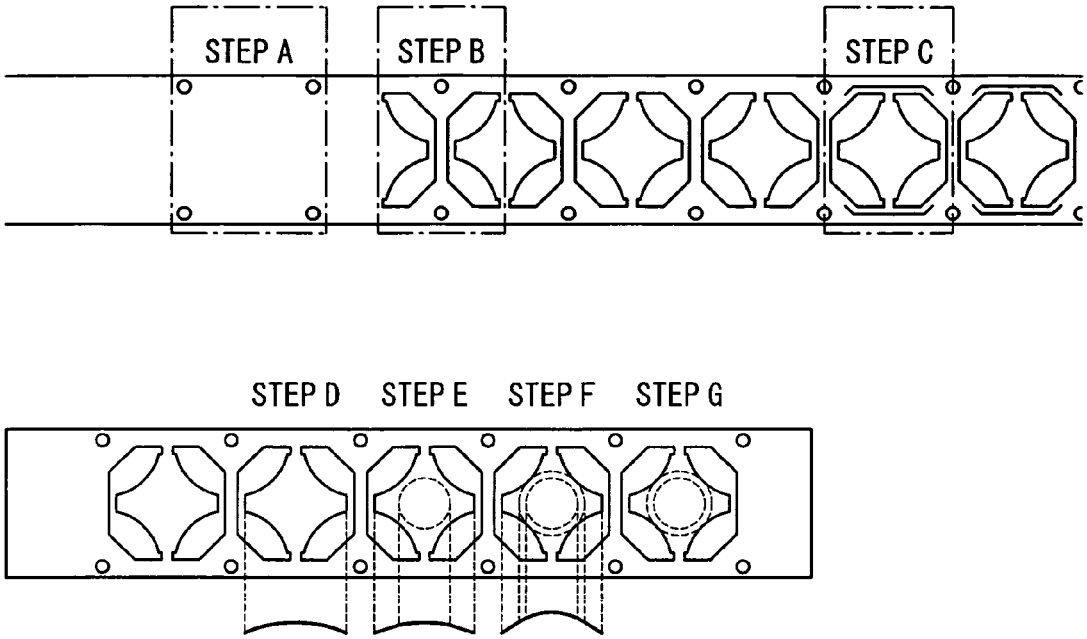
FIG. 12 a view illustrating a method for manufacturing a switch diaphragm.

FIG. 12 illustrates a method for manufacturing the switch diaphragm of the first embodiment shown in FIG. 3A.

Figure 13:
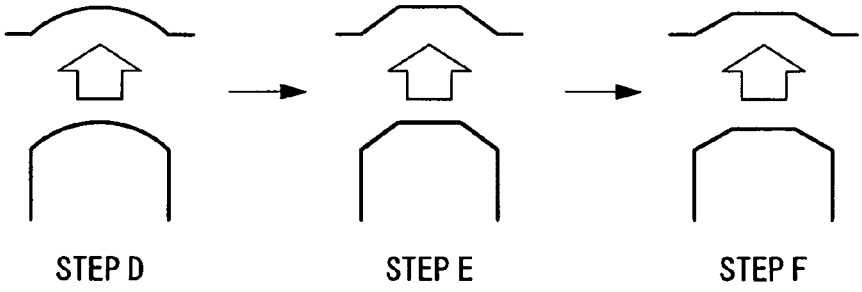
FIG. 13 is a view illustrating molds used in the method shown in FIG. 12.

First, a plate material (metal plate or the like), which is a material of the switch diaphragm of the invention, is subjected to three-stage stamping steps of Steps A-C to fabricate a workpiece prior to drawing steps. Next, the workpiece is subjected to three-stage drawing steps of Steps D-F. The molds shown in FIG. 13 are used, and an R press is performed in Step D, a trapezoid press (for the inner portion) is performed in Step E, and a trapezoid press (for the outer portion) is performed in Step F. In the final step, Step G, the bridges are cut, as shown by the broken lines in FIG. 12.

It should be noted that in the case of a diaphragm having holes formed therein, an additional stamping step for forming the hole portions at predetermined positions is performed somewhere between Step A to Step D.

In the case of a diaphragm having reduced thickness portion(s) formed therein, a compression step for forming the reduced thickness portion(s) at predetermined position (s) is performed somewhere between Step A to Step D.

The switch diaphragms of embodiments other than the first embodiment can be manufactured with steps similar to the steps described above.

Figure 14:
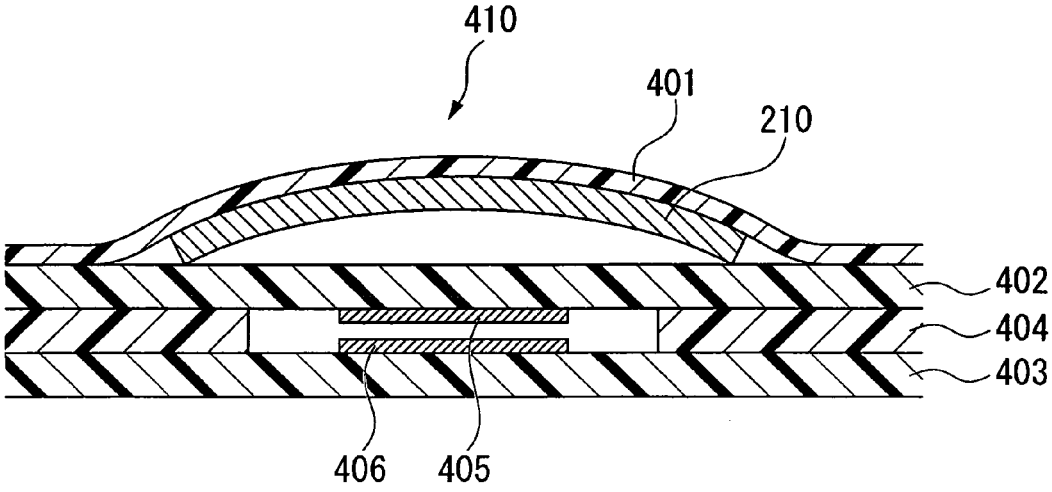
FIG. 14 is a cross-sectional view illustrating one embodiment of a switch according to the invention.
Figure 16:
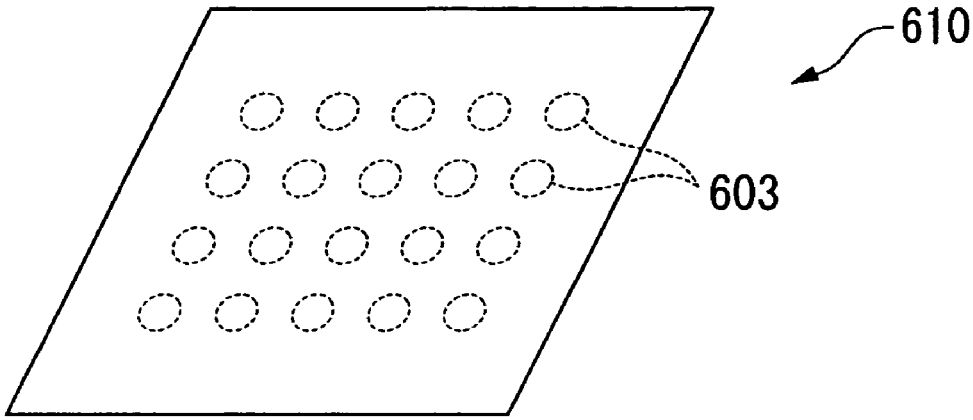
FIG. 16 is a perspective view illustrating the switch shown in FIG. 14 or FIG. 15.

Next, a switch using the diaphragm according to the invention will be described. FIG. 14 is a cross-sectional view illustrating a switch 401 using the diaphragm according to the invention, and FIG. 16 is a perspective view of this switch 401. The switch 401 includes an upper electrode sheet 402 having an upper electrode 405 and a lower electrode sheet 403 having a lower electrode 406, in which a spacer sheet 404 made of polyethylene terephthalate (PET) is interposed between the two electrode sheets 402 and 403, thereby isolating the upper electrode 405 from the lower electrode 406. The switch diaphragm (metal dome) 210 according to the invention is placed on the upper electrode sheet 402, and the metal dome 210 is covered with a metal dome holding sheet 401.

The upper electrode sheet 402, the lower electrode sheet 403, and the spacer sheet 404 may be made of, for example, PET, and the thickness thereof may be 75 μm. The metal dome holding sheet 401 may be made of, for example, PET, and the thickness thereof may be between 25 μm and 50 μm. The metal dome 210 may be made of stainless steel, and the outer diameter thereof may be, for example, between 6 mm and 20 mm.

When the center portion of the metal dome 210 is depressed, the upper electrode sheet 402 is deformed downward. As a result, the upper electrode 405 comes in contact with the lower electrode 406 to establish an electric contact, which turns the switch on.

Since the switch diaphragm according to the invention is used in the switch of the invention, a user can have a satisfactory "click feeling" and the load required for making a click can be reduced.

Figure 15:
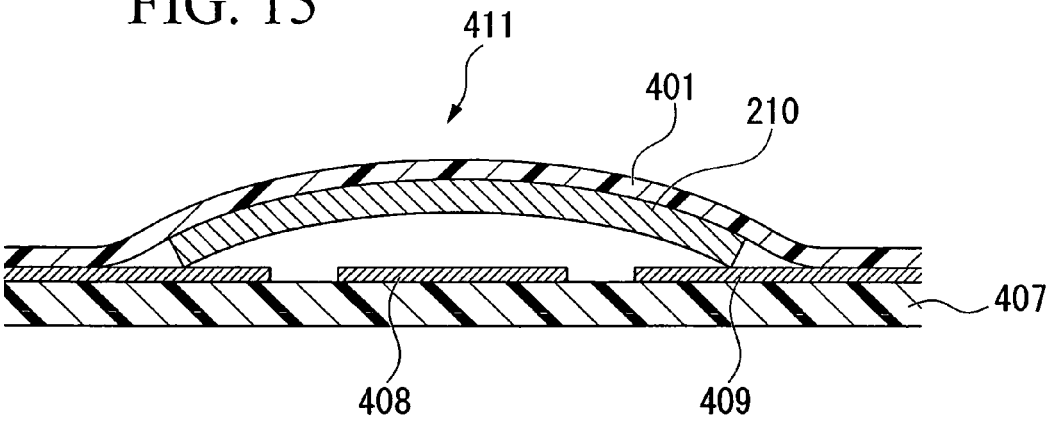
FIG. 15 is a cross-sectional view illustrating another embodiment of a switch according to the invention.

An alternative switch according to the invention is shown in FIG. 15, and FIG. 16 is a perspective view of this switch. A switch 411 shown in FIG. 15 is similar to the switch 410 shown in FIG. 14 in that the switch diaphragm (metal dome)

210 according to the invention and the metal dome holding sheet 401 are used. However, an electrode has a single-layer structure, in which a conductive circuit 408 and a conductive circuit 409, which constitutes contacting members, are formed on an electrode sheet 407. The conductive circuits 408 and 409 may be made of copper (Cu), silver (Ag), or the like.

When the center portion of the metal dome 210 is depressed, the metal dome 210 comes in contact with the conductive circuit 408 to establish an electric contact, which turns the switch on.

Figure 17A:
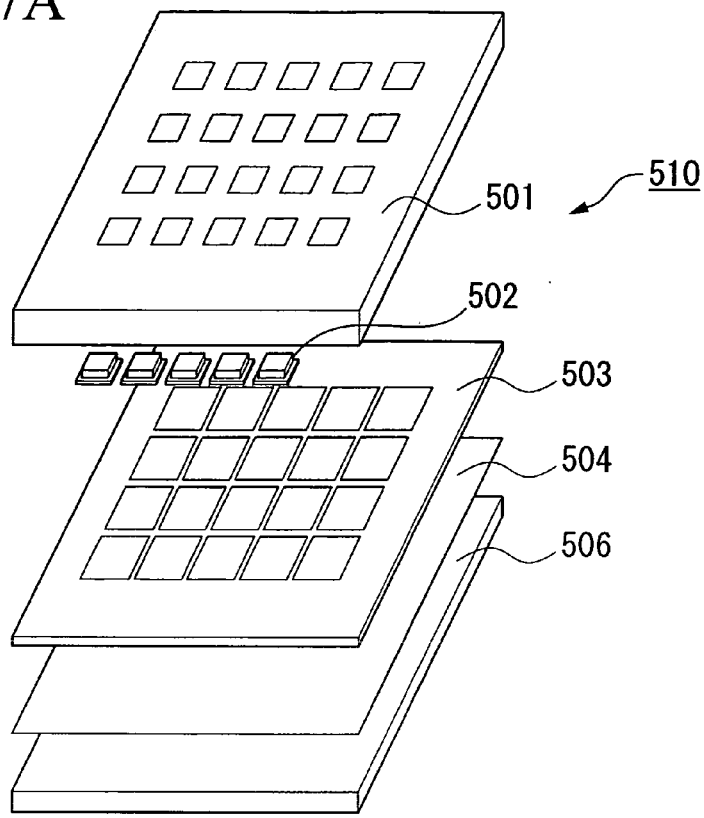
FIG. 17A is an exploded perspective view illustrating an input device according to the invention.
Figure 17B:
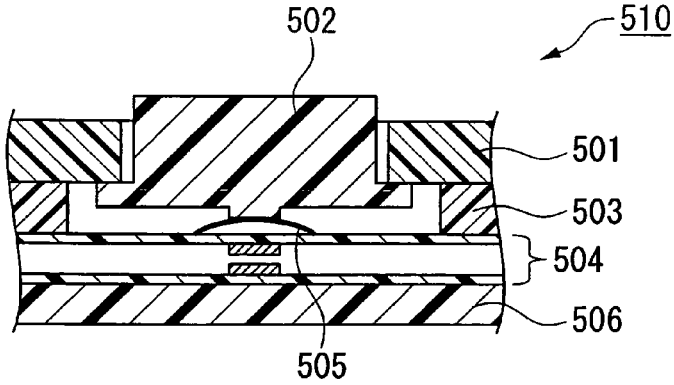
FIG. 17B is a cross-sectional view illustrating the input device according to the invention.

Next, an input device using the switch diaphragm according to the invention will be described. As an example of such an input device, an exploded perspective view and a cross-sectional view of a keyboard 510 are shown in FIG. 17A and FIG. 17B, respectively. The keyboard 510 includes a housing 501, key tops 502, a frame 503, a plate-like switch 504, movable contacts 505, and a reinforcing plate 506, and among these members, the switch diaphragm of the invention is used for the movable contacts 505.

Since the input device according to the invention employs the switch of the invention, a user can have a satisfactory "click feeling" and the load required for making a click can be reduced. The input device according to the invention can be used in various electronic apparatuses, such as a portable telephone, a personal computer, a personal digital assistant (PDA), or the like, and is particularly suited to an application in which a satisfactory "click feeling" is desired.

While exemplary embodiments of the invention have been described and illustrated above, it should be understood that these are examples of the invention and are not to be considered as limiting. Additions, omissions, substitutions, and other modifications can be made without departing from the spirit or scope of the invention. Accordingly, the invention is not to be considered as being limited by the foregoing description, and is only limited by the scope of the appended claims.

What is claimed is:

1. A dome-shaped diaphragm, comprising:
a convex portion having a first cross-sectional shape;
a base portion provided on an outer periphery of the convex portion, the base portion having a second cross-sectional shape different from the first; and
a hole provided in at least one of the convex portion and the base portion
wherein the hole is disposed at the circumference of the convex portion.

2. The dome-shaped diaphragm according to claim 1, wherein a plurality of holes are provided.

3. The dome-shaped diaphragm according to claim 1, wherein the first cross-sectional shape is an arc, and the second cross-sectional shape is a straight line.

4. The dome-shaped diaphragm according to claim 1, wherein the cross-sectional shapes are taken along a direction of operation of the dome-shaped diaphragm.

5. A dome-shaped diaphragm, comprising:
a convex portion having a first cross-sectional shape;
a base portion provided on an outer periphery of the convex portion, the base portion having a second cross-sectional shape different from the first;
a hole provided in at least one of the convex portion and the base portion; and
a plurality of cut-out portions in the dome-shaped diaphragm.

6. A dome-shaped diaphragm, comprising:
a convex portion;
a base portion provided on an outer periphery of the convex portion; and
a concave-shaped reduced thickness portion provided in at least one of the convex portion and the base portion.

7. The dome-shaped diaphragm according to claim 6, further comprising a plurality of cut-out portions in the dome-shaped diaphragm.

8. The dome-shaped diaphragm according to claim 6, wherein a plurality of reduced thickness portions are provided.

9. The dome-shaped diaphragm according to claim 6, wherein: the convex portion has a first cross-sectional shape; and the base portion has a second cross-sectional shape different from the first.

10. The dome-shaped diaphragm according to claim 9, wherein the first cross-sectional shape is an arc, and the second cross-sectional shape is a straight line.

11. The dome-shaped diaphragm according to claim 9, wherein the cross-sectional shapes are taken along a direction of operation of the dome-shaped diaphragm.

12. The dome-shaped diaphragm according to claim 6, wherein the concave-shaped reduced thickness portion extends across both the convex portion and the base portion.

13. A dome-shaped diaphragm, comprising:
a convex portion having a first cross-sectional shape;
a base portion provided on an outer periphery of the convex portion, the base portion having a second cross-sectional shape different from the first; and
a plurality of leg portions provided on an outer periphery of the base portion; and
a hole provided in at least one of the convex portion, the base portion, and the leg portions;
wherein the hole is disposed at the circumference of the convex portion.

14. The dome-shaped diaphragm according to claim 13, wherein a plurality of holes are provided.

15. The dome-shaped diaphragm according to claim 13, wherein the first cross-sectional shape is an arc, and the second cross-sectional shape is a straight line.

16. The dome-shaped diaphragm according to claim 13, wherein the cross-sectional shapes are taken along a direction of operation of the dome-shaped diaphragm.

17. The dome-shaped diaphragm according to claim 16, wherein: the leg portions have a straight line cross-sectional shape; and the leg portions are arranged at a steeper angle than the base portion relative to the direction of operation of the dome-shaped diaphragm.

18. The dome-shaped diaphragm according to claim 13, wherein only the distal ends of the leg portions contact a substrate upon which the dome-shaped diaphragm is provided.

19. A dome-shaped diaphragm, comprising:
a convex portion having a first cross-sectional shape;
a base portion provided on an outer periphery of the convex portion, the base portion having a second cross-sectional shape different from the first; and
a plurality of leg portions provided on an outer periphery of the base portion; and
a hole provided in at least one of the convex portion, the base portion, and the leg portions;
wherein the plurality of holes are provided at positions corresponding to positions of the plurality of leg portions.

20. A dome-shaped diaphragm, comprising:
a convex portion;
a base portion provided on an outer periphery of the convex portion; and a plurality of leg portions provided on an outer periphery of the base portion; and a concave-shaped reduced thickness portion provided in at least one of the convex curved portion, the base portion, and the leg portions.

21. The dome-shaped diaphragm according to claim 20, wherein a plurality of reduced thickness portions are provided.

22. The dome-shaped diaphragm according to claim 21, wherein the plurality of reduced thickness portions are provided at positions corresponding to positions of the plurality of leg portions.

23. A membrane switch comprising the diaphragm according to any one of claim 1 to 22.

24. An input device comprising the diaphragm according to any one of claim 1 to 22.

25. The dome-shaped diaphragm according to claim 20, wherein: the convex portion has a first cross-sectional shape; and the base portion has a second cross-sectional shape different from the first.

26. The dome-shaped diaphragm according to claim 25, wherein the first cross-sectional shape is an arc, and the second cross-sectional shape is a straight line.

27. The dome-shaped diaphragm according to claim 25, wherein the cross-sectional shapes are taken along a direction of operation of the dome-shaped diaphragm.

28. The dome-shaped diaphragm according to claim 27, wherein: the leg portions have a straight line cross-sectional shape; and the leg portions are arranged at a steeper angle than the base portion relative to the direction of operation of the dome-shaped diaphragm.

29. The dome-shaped diaphragm according to claim 20, wherein the concave-shaped reduced thickness portion extends across both the convex portion and the base portion.

30. The dome-shaped diaphragm according to claim 20, wherein the concave-shaped reduced thickness portion extends across the convex portion, the base portion and the leg portion.

31. The dome-shaped diaphragm according to claim 20, wherein only the distal ends of the leg portions contact a substrate upon which the dome-shaped diaphragm is provided.

32. A method for manufacturing a diaphragm, comprising:

providing a sheet material;

forming in the sheet material a convex portion having a first cross-sectional shape and a base portion on an outer periphery of the convex portion, the base portion having a second cross-sectional shape different from the first; and forming a hole portion in at least one of the convex portion and the base portion wherein the hole is disposed at the circumference of the convex portion.

33. The dome-shaped diaphragm according to claim 32, wherein the hole extends across both the convex portion and the base portion.

34. A method for manufacturing a diaphragm, comprising:

providing a sheet material;

forming in the sheet material a convex portion having a first cross-sectional shape and a base portion on an outer periphery of the convex portion, the base portion having a second cross-sectional shape different from the first; and forming a concave-shaped reduced thickness portion in at least one of the convex portion and the base portion.

35. The dome-shaped diaphragm according to claim 34, wherein the reduced thickness portion extends across both the convex portion and the base portion.

36. A dome-shaped diaphragm, comprising:

a convex portion having a first cross-sectional shape;

a base portion provided on an outer periphery of the convex portion, the base portion having a second cross-sectional shape different from the first; and a hole provided in at least one of the convex portion and the base portion;

wherein the hole extends across both the convex portion and the base portion.

37. A dome-shaped diaphragm, comprising:

a convex portion having a first cross-sectional shape;

a base portion provided on an outer periphery of the convex portion, the base portion having a second cross-sectional shape different from the first; and a plurality of leg portions provided on an outer periphery of the base portion; and a hole provided in at least one of the convex portion, the base portion, and the leg portions;

wherein the hole extends across both the convex portion and the base portion.

38. The dome-shaped diaphragm according to claim 37, wherein the hole further extends across the leg portion.

* * * * *